United States Patent [19]

Fouracre

[11] 4,024,597

[45] May 24, 1977

[54] SIMULTANEOUS FLOOR EDGE AND BASEBOARD CLEANER

[75] Inventor: Roy E. Fouracre, Mississauga, Canada

[73] Assignee: The Raymond Lee Organization, Inc., New York, N.Y.

[22] Filed: July 6, 1976

[21] Appl. No.: 703,001

[52] U.S. Cl. ..... 15/28; 15/49 R; 51/170 T

[51] Int. Cl.[2] ..... A47L 11/16; A46B 13/02

[58] Field of Search ..... 15/28, 29, 49 R, 50 R, 15/52, 87, 93, 97 R, 98, 103, 385, 21 R; 51/170 T, 177, 180

[56] References Cited

UNITED STATES PATENTS

| | | | |
|---|---|---|---|
| 1,142,482 | 6/1915 | Bisch | 15/28 X |
| 1,988,024 | 1/1935 | Tilke | 15/50 R |
| 2,989,763 | 6/1961 | Bradley | 15/50 R |
| 3,327,338 | 6/1967 | Young | 15/98 |
| 3,533,120 | 10/1970 | DeMercado | 15/50 A |

*Primary Examiner*—Edward L. Roberts
*Attorney, Agent, or Firm*—Stephen Wyden

[57] ABSTRACT

A housing contains a motor driven by an electrical source and a shaft connected to the motor drives a brush which can clean a tile floor while a bevelled gear attached to the shaft may drive a second bevelled gear connected to a perpendicular shaft which passes through the housing, a brush attached to the perpendicular shaft may clean a sideboard while if the edge of the sideboard cleaning brush is bevelled then the baseboard cleaning brush may also clean the bevelled corner between the floor and the baseboard.

3 Claims, 4 Drawing Figures

SIMULTANEOUS FLOOR EDGE AND BASEBOARD CLEANER

I have invented a new and novel simultaneous floor edge and baseboard cleaner. My device can be used to clean the edge of a tile floor and the baseboard adjacent thereto and if the edge of the baseboard cleaning brush is properly shaped the bevelled corner between the baseboard and the tile floor can also be properly cleaned.

My invention can be understood in view of the accompanying figures.

Figure 1:
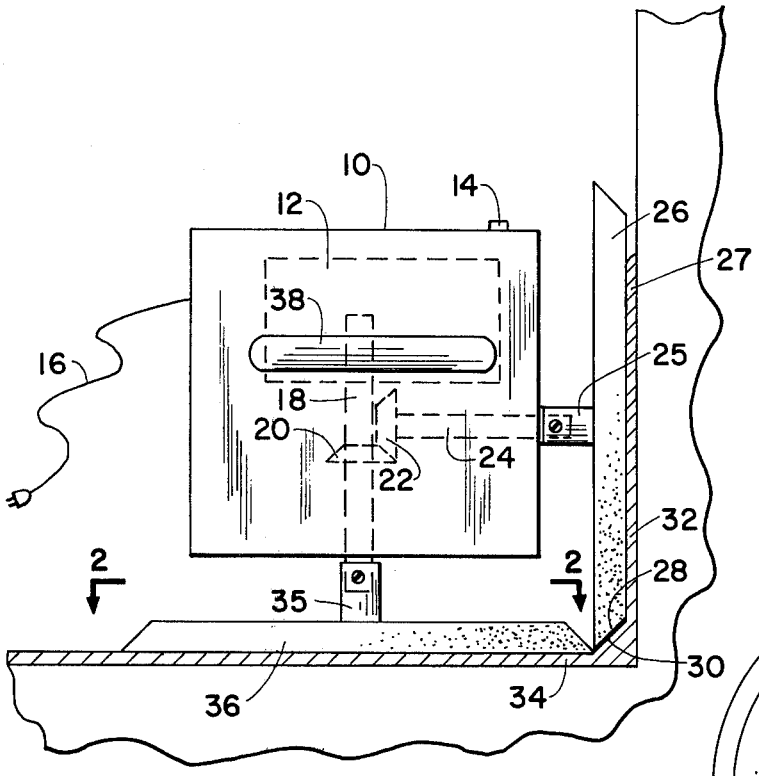
FIG. 1 is a side view of the cleaner in use.
Figure 2:
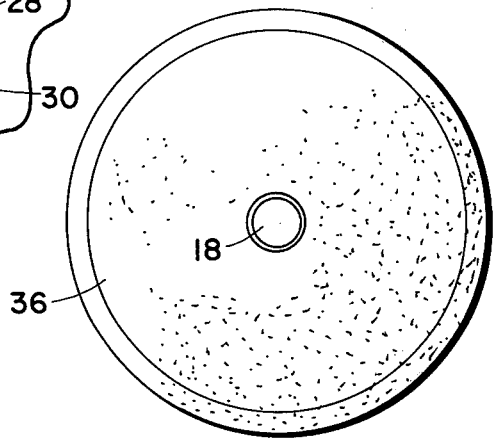
FIG. 2 is a section of the cleaner of FIG. 1, taken in the plane 2—2.
Figure 3:
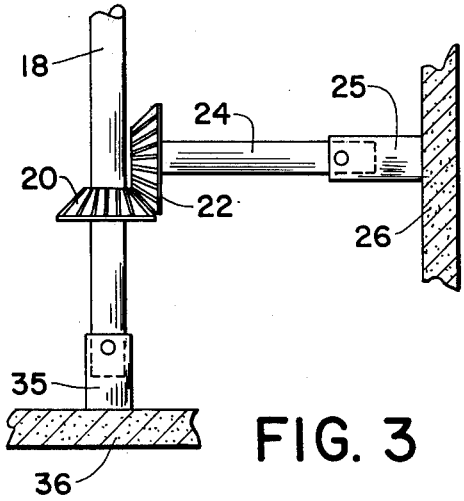
FIG. 3 is a partially sectioned interior view of the connection between the brushes.
Figure 4:
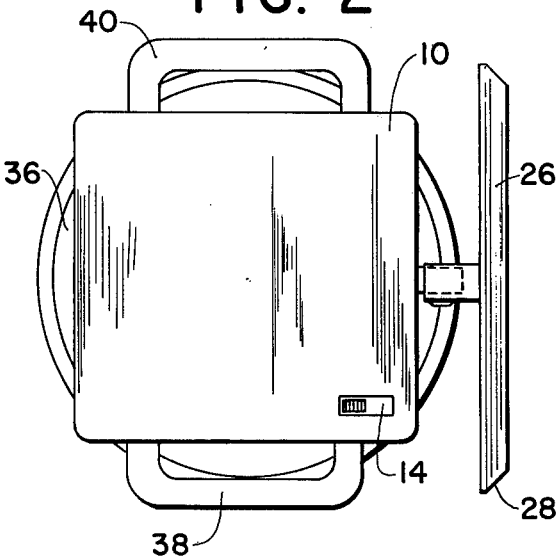
FIG. 4 is a top view of the cleaner.

With regard to FIGS. 1, 2, 3, and 4, a housing 10 can contain a motor 12 operated by an on off switch 14 which is connected to an electrical cord 16 for connection to an electrical source. A shaft 18 connected to the motor 12 bears a bevelled gear 20 which engages another bevelled gear 22 at right angles to the first shaft 18. The second bevelled gear 22 is connected to another shaft 24 at right angles to the first shaft 18 which is connected by a connector 25 to a brush 26 which can clean the baseboard 27. The bevelled edge 28 of the brush 26 can fit the bevelled corner 30 between the baseboard 27 and the tile floor 34. A connector 35 connected to the bottom end of the shaft 18 is connected to a brush 36 for cleaning the tile floor 34. The housing 10 can be moved by side handles 38 and 40.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A simultaneous floor edge and baseboard cleaner, comprising:

a housing, a motor mounted in the housing and connected to an electrical source, a shaft connected to the motor and extending through the housing downwardly, a brush attached to a distal end of the shaft, whereby a floor may be cleaned, a bevelled gear attached to a portion of the shaft, a second bevelled gear engaging the bevelled gear, a shaft connected to the second bevelled gear at right angles to the shaft and extending through the housing, and a brush attached to a distal end of the second shaft, whereby a baseboard may be cleaned.

2. The cleaner of claim 1, further comprising:

an edge of the brush connected to the second shaft forming a bevelled edge, whereby a bevelled corner between the baseboard and the floor may be cleaned by the brush.

3. The cleaner of claim 2, further comprising:

a pair of handles each attached to a side of the housing adjacent to the side through which the second shaft passes, whereby the movement of the cleaner may be controlled.

* * * * *